United States Patent [19]

Pelrine

[11] Patent Number: 5,015,795

[45] Date of Patent: May 14, 1991

[54] NOVEL SYNTHETIC LUBE COMPOSITION AND PROCESS

[75] Inventor: Bruce P. Pelrine, Trenton, N.J.

[73] Assignee: Mobil Oil Corporation, Fairfax, Va.

[21] Appl. No.: 562,179

[22] Filed: Aug. 3, 1990

Related U.S. Application Data

[63] Continuation of Ser. No. 313,576, Feb. 21, 1989, abandoned.

[51] Int. Cl.[5] ..... C07C 2/12; C07C 2/62

[52] U.S. Cl. ..... 585/330; 585/314; 585/510; 585/530; 585/722; 585/723; 585/725; 585/726; 585/727; 585/730

[58] Field of Search ..... 585/332, 314, 510, 530, 585/722, 723, 725, 726, 727, 730

[56] References Cited

U.S. PATENT DOCUMENTS

| | | | |
|---|---|---|---|
| 3,442,964 | 5/1969 | Oldham | 585/332 |
| 3,637,503 | 1/1972 | Giannetti et al. | 585/10 |
| 3,795,616 | 3/1974 | Heilman et al. | 585/10 |
| 4,247,421 | 1/1981 | McDaniel et al. | 252/458 |
| 4,282,392 | 8/1981 | Cupples et al. | 585/10 |
| 4,368,141 | 1/1983 | Kukes | 585/646 |
| 4,368,342 | 1/1983 | Slaugh | 585/446 |
| 4,587,368 | 5/1986 | Pratt | 585/12 |
| 4,605,810 | 8/1986 | Banks | 585/646 |
| 4,609,769 | 9/1986 | Kukes et al. | 585/646 |
| 4,665,245 | 5/1987 | Quann | 585/316 |
| 4,827,064 | 5/1989 | Wu | 585/10 |
| 4,827,073 | 5/1989 | Wu | 585/530 |
| 4,912,277 | 3/1990 | Aufdembrink et al. | 585/455 |
| 4,914,254 | 4/1990 | Pelrine | 585/530 |

FOREIGN PATENT DOCUMENTS

| | | | |
|---|---|---|---|
| 3427319 | 1/1986 | Fed. Rep. of Germany | 585/10 |
| 2414543 | 1/1978 | France | 585/646 |
| 636372 | 4/1950 | United Kingdom | 585/10 |

OTHER PUBLICATIONS

Weiss et al., "Surface Compounds of Transition Metals", J. Catalysis, vol. 88, 424–430 (1984).

*Primary Examiner*—Asok Pal

*Attorney, Agent, or Firm*—Alexander J. McKillop; Charles J. Speciale; Malcolm D. Keen

[57] ABSTRACT

The thermal stability of synthetic lubricants composed of alpha-olefin oligomers is improved by reaction with an olefin such as decene or the lower molecular weight, non-lubricant range olefins produced in the course of the oligomerization of 1-alkenes. The alkylation of the lube range oligomer is carried out using acidic alkylation catalyst such as solid, open-pore catalyst, e.g., fluorided alumina.

The improved lubricant compositions of the present invention comprise a high viscosity index liquid lubricant oligomer composition containing $C_{30}$–$C_{1300}$ hydrocarbons with at least one higher alkyl branch per oligomer molecule, said alkyl branch containing between 12 and 40 carbon atoms. In a preferred embodiment the novel alkylated lubricant composition has a methyl to methylene branch ratio of less than 0.19 and pour point below −15° C.

5 Claims, 2 Drawing Sheets

NOVEL SYNTHETIC LUBE COMPOSITION AND PROCESS

This is a continuation of copending application Ser. No. 313,576, filed on Feb. 21, 1989, now abandoned.

This invention relates to novel compositions prepared from synthetic lubricants by reaction with olefins and to the process for their production. The invention particularly pertains to the modification of a high viscosity index synthetic lubricant oligomer fraction employing low molecular weight by-product oligomer fractions as reactant. The modified synthetic lubricants are themselves useful, inter alia, as lubricants with improved thermal stability.

BACKGROUND OF THE INVENTION

Efforts to improve upon the performance of natural mineral oil based lubricants by the synthesis of oligomeric hydrocarbon fluids have been the subject of important research and development in the petroleum industry for at least fifty years and have led to the relatively recent market introduction of a number of superior polyalpha-olefin synthetic lubricants, primarily based on the oligomerization of alpha-olefins or 1-alkenes. In terms of lubricant property improvement, the thrust of the industrial research effort on synthetic lubricants has been toward fluids exhibiting useful viscosities over a wide range of temperature, i.e., improved viscosity index, while also showing lubricity, thermal and oxidative stability and pour point equal to or better than mineral oil. These new synthetic lubricants lower friction and hence increase mechanical efficiency across the full spectrum of mechanical loads from worm gears to traction drives and do so over a wider range of operating conditions than mineral oil lubricants.

One characteristic of the molecular structure of 1-alkene oligomers that has been found to correlate very well with improved lubricant properties in commercial synthetic lubricants is the ratio of methyl to methylene groups in the oligomer. The ratio is called the branch ratio and is calculated from infra red data as discussed in "Standard Hydrocarbons of High Molecular Weight", *Analytical Chemistry,* Vol.25, no.10, p.1466 (1953). Viscosity index has been found to increase with lower branch ratio. Until recently, as cited herein, oligomeric liquid lubricants exhibiting very low branch ratios have not been synthesized from 1-alkenes. For instance, oligomers prepared from 1-decene by either cationic polymerization or Ziegler catalyst polymerization have branch ratios of greater than 0.20. Shubkin, *Ind. Eng. Chem. Prod. Res. Dev.* 1980, 19, 15–19, provides an explanation for the apparently limiting value for branch ratio based on a cationic polymerization reaction mechanism involving rearrangement to produce branching. Other explanations suggest isomerization of the olefinic group in the one position to produce an internal olefin as the cause for branching. Whether by rearrangement, isomerization or a yet to be elucidated mechanism it is clear that in the art of 1-alkene oligomerization to produce synthetic lubricants as commercially practiced excessive branching occurs and constrains the limits of achievable lubricant properties, particularly with respect to viscosity index. Obviously, increased branching increases the number of isomers in the oligomer mixture, orienting the composition away from the structure which would be preferred from a consideration of the theoretical concepts discussed above.

U.S. Pat. No. 4,282,392 to Cupples et al. discloses an alpha-olefin oligomer synthetic lubricant having an improved viscosity-volatility relationship and containing a high proportion of tetramer and pentamer via a hydrogenation process that effects skeletal rearrangement and isomeric composition. The composition claimed is a trimer to tetramer ratio no higher than one to one. The branch ratio is not disclosed.

A process using coordination catalysts to prepare high polymers from 1-alkenes, especially chromium catalyst on a silica support, is described by Weiss et al. in Jour. Catalysis 88, 424–430 (1984) and in Offen. DE 3,427,319. The process uses low temperatures to produce high polymer and does not disclose lubricants having unique structure.

Recently, novel lubricant compositions (referred to herein as HVI-PAO) comprising polyalpha-olefins and methods for their preparation employing as catalyst reduced chromium on a silica support have been disclosed in U.S. patent applications Ser. No. 210,434 and 210,435 filed June 23, 1988, incorporated herein by reference in their entirety. The HVI-PAO lubricants are made by a process which comprises contacting $C_6$–$C_{20}$ 1-alkene feedstock with reduced valence state chromium oxide catalyst on porous silica support under oligomerizing conditions in an oligomerization zone whereby high viscosity, high VI liquid hydrocarbon lubricant is produced having branch ratios less than 0.19 and pour point below −15° C. The process is distinctive in that little isomerization of the olefinic bond occurs compared to known oligomerization methods to produce polyalpha-olefins using Lewis acid catalyst. Lubricants produced by the process cover the full range of lubricant viscosities and exhibit a remarkably high viscosity index (VI) and low pour point even at high viscosity. The as-synthesized HVI-PAO oligomer has a preponderance of terminal olefinic unsaturation. Typically, the HVI-PAO oligomer is hydrogenated to improve stability for lubricant applications. Those modifications to HVI-PAO oligomers that result in improved thermal stability are particularly preferred.

In the preparation of the novel HVI-PAO lubricant, alpha-olefin dimer containing olefinic unsaturation can be separated from the oligomerization reaction. The composition of the dimer mixture conforms to the unique specificity of the oligomerization reaction in that little double bond isomerization is found and shows a low branch ratio. Separation of the dimer, representing non-lube range molecular weight material, is necessitated to control product volatility and viscosity. However, as oligomerization conditions are changed to produce the lower viscosity products of lower average molecular weight important to the marketplace, the non-lube range dimer fraction by-product yield increases in proportion to that lowering in average molecular weight of the oligomerization product. The increase in dimer by-product yield represents a substantial economic burden on the overall process to produce useful lower viscosity lubricant.

It would therefore be desirable to incorporate the non-lube range fractions into the product in order to avoid the economic penalty associated with the production of the lower viscosity lubricants.

SUMMARY OF THE INVENTION

It has been found that the non-lube range olefins produced in the oligomerization process can be effectively converted to lube range products by reaction with the lube range material. It has also been found that other olefins may also be used in a similar manner and that the reaction products possess unexpectedly better thermal stability than the original lube range material, regardless of the character of the olefin. The yield of lubricant material is also improved in this way.

According to the present invention we, therefore, provide a method for improving the thermal stability of synthetic lube produced by the oligomerization of a 1-alkene (alpha-olefin) which comprises reacting the oligomer with an olefin. The reaction, which is believed to proceed mainly by alkylation with some side reactions such as cracking, isomerization and polymerization, is carried out in the presence of an alkylation catalyst under conditions appropriate for alkylation.

A preferred olefin for reaction with the lube oligomer is the lower molecular weight, non-lubricant olefin produced in the course of the oligomerization of the alpha-olefin starting material. Using these lower molecular weight materials in this way not only improves the thermal stability of the final lube products but also increases the product yield and olefin utilization, so avoiding the economic penalty attached to the production of the lower viscosity range lubricants. In a preferred embodiment of the present invention, therefore, the lower molecular weight non-lubricant range olefinic hydrocarbons produced in the course of the oligomerization of 1-alkenes are used to upgrade the lube range oligomer.

The reaction is carried out using acidic catalyst. Effective acidic catalysts comprise alkylation catalysts, preferably the open-pore catalyst such as those derived from fluorided alumina.

The composition of the present invention is polymeric residue of linear $C_6$–$C_{20}$ 1-alkenes, which has at least one higher alkyl ($C_{12}$–$C_{40}$) branch per oligomer molecule. The hydrocarbon oligomer generally contains from 30 to 1300 carbon atoms per molecule. In a preferred embodiment the novel composition has a methyl to methylene branch ratio of less than 0.19 and pour point below −15° C.

The preferred process for the conversion of the alphaolefins to the desired thermally stable, high viscosity index lubricant product comprises: contacting $C_6$ to $C_{20}$ alphaolefin feedstock, or mixtures thereof, under oligomerization conditions with a reduced valence state Group VIB metal catalyst on porous support whereby an oligomerization product mixture is produced containing oligomers comprising olefinic lubricant range hydrocarbons and olefinic non-lubricant range hydrocarbon by-product; separating said lubricant and non-lubricant hydrocarbons and hydrogenating said lubricant range hydrocarbons; contacting said hydrogenated hydrocarbons and said olefinic by-product hydrocarbons as alkylating agent in an alkylation zone under alkylating conditions with acidic catalyst whereby alkylated lubricant range hydrocarbons are produced.

DETAILED DESCRIPTION OF THE INVENTION

Figure 1:
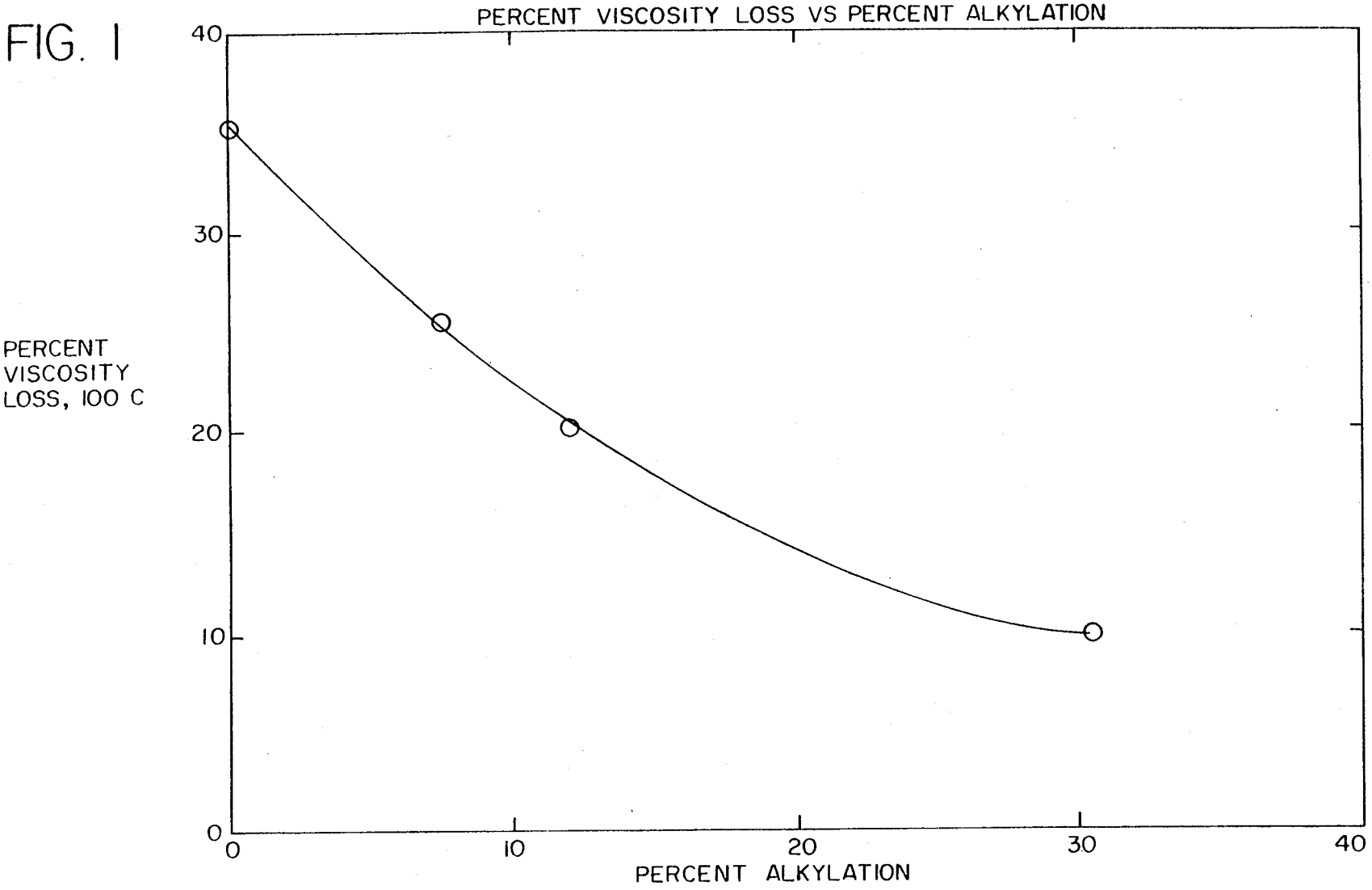
FIG. 1 shows the relationship between degree of alkylation and viscosity loss for modified HVI-PAO.

In the preferred embodiments of the present invention synthetic hydrocarbon lubricants are modified by reaction with alkenes including the unique olefin dimers produced as by-product in the oligomerization reaction that produces the synthetic lubricant. The alkenes which can be used to react with HVI-PAO oligomers as described herein include $C_2$–$C_{40}$ linear or branched alkenes but, in particular, 1-alkenes and the olefinic dimer by-product of the HVI-PAO oligomerization reaction Preferred 1-alkenes for reaction with HVI-PAO oligomers include those olefins containing from 6 to about 14 carbon atoms such as 1-hexene, 1-octene, 1-decene, 1-dodecene and 1-tetradecene and branched chain isomers such as 4-methyl-1-pentene. Particularly preferred 1-alkenes are the $C_8$ to $C_{10}$ alpha-olefins, e.g., 1-octene, 1-decene and the olefin dimers produced in the oligomerization process for producing the initial lube range materials.

The oligomerization reaction is carried out by the oligomerization of 1-alkenes in contact with reduced metal catalysts, preferably reduced chromium oxide on a silica support. A characteristic of the novel oligomerization reaction from which the by-product dimers used as alkylating agent in the present invention are produced is the production of mixtures of dialkyl vinylidenic and 1,2 dialkyl or trialkyl mono-olefin oligomers, or HVI-PAO oligomers, as determined by infra-red and NMR analysis. However, in general, the HVI-PAO oligomers have the following regular head-to-tail structure where n is preferably 0 to 17, terminating in olefinic unsaturation:

$$-(CH_2-\underset{\substack{(CH_2)_n\\ CH_3}}{CH})_x-$$

with some head-to-head connections.

The HVI-PAO process produces a surprisingly simpler and useful dimer compared to the dimer produced by 1-alkene oligomerization with $BF_3$ or $AlCl_3$ as commercially practiced. Typically, in the present invention it has been found that a significant proportion of unhydrogenated dimerized 1-alkene, or alpha-olefin, has a vinylidenyl structure as follows:

$$CH_2=CR_1R_2$$

where, $R_1$ and $R_2$ are alkyl groups representing the residue from the head-to-tail addition of 1-alkene molecules. For example, the by-product dimer from 1-decene oligomerization according to the HVI-PAO process, which can be used as alkylating olefin in the present invention, has been found to contain three major components, as determined by GC. Based on $C_{-13}$ NMR analysis, the unhydrogenated components were found to be 8-eicosene, 9-eicosene, 2-octyldodecene and 9-methyl-8 or 9-methyl-9-nonadecene.

Olefins suitable for use as starting material in the preparation of olefinic HVI-PAO oligomers and the by-product dimer used as starting material in the present invention include those olefins containing from 6 to about 14 carbon atoms such as 1-hexene, 1-octene, 1-decene, 1-dodecene and 1-tetradecene and branched chain isomers such as 4-methyl-1-pentene. A preferred 1-alkene is 1-decene. Also suitable for use are olefin-containing refinery feedstocks or effluents. However, the olefins used in this invention are preferably alpha olefinic as for example 1-octene to 1-dodecene and more preferably 1-decene, or mixtures of such olefins.

The lube range HVI-PAO oligomers of alpha-olefins used in this invention have a low branch ratio of less than 0.19 and superior lubricating properties compared to the alphaolefin oligomers with a high branch ratio, as produced in all known commercial methods.

This class of unsaturated HVI-PAO alpha-olefin oligomers are prepared by oligomerization reactions in which a major proportion of the double bonds of the alpha-olefins are not isomerized. These reactions include alpha-olefin oligomerization by supported metal oxide catalysts, such as Cr compounds on silica or other supported IUPAC Periodic Table Group VIB compounds. The catalyst most preferred is a lower valence Group VIB metal oxide on an inert support. Preferred supports include silica, alumina, titania, silica alumina, magnesia and the like. The support material binds the metal oxide catalyst. Those porous substrates having a pore opening of at least 40 angstroms are preferred.

The support material usually has high surface area and large pore volumes with average pore size of 40 to about 350 angstroms. The high surface area are beneficial for supporting large amount of highly dispersive, active chromium metal centers and to give maximum efficiency of metal usage, resulting in very high activity catalyst. The support should have large average pore openings of at least 40 angstroms, with an average pore opening of >60 to 300 angstroms preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a silica support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$, $R_2Mg$, RLi, $R_2Zn$, where R is alkyl, alkoxy, aryl and the like. Preferred are CO or $H_2$ or metal alkyl containing compounds. Alternatively, the Group VIB metal may be applied to the substrate in reduced form, such as CrII compounds. The resultant catalyst is very active for oligomerizing olefins at a temperature range from below room temperature to about 250° C. at a pressure of 0.1 atmosphere to 5000 psi. However, oligomerization temperature is preferably between 90°-250° C. at a feedstock to catalyst weight ratio between 10:1 and 30:1. Contact time of both the olefin and the catalyst can vary from one second to 24 hours. The catalyst can be used in a batch type reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours. Thereafter the catalyst is cooled down under an inert atmosphere to a temperature of about 250° to 450° C. and a stream of pure reducing agent is contacted therewith for a period when enough CO has passed through to reduce the catalyst as indicated by a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature and is ready for use.

The product oligomers have a very wide range of viscosities with high viscosity indices suitable for high performance lubrication use. The product oligomers also have a tactic molecular structure of mostly uniform head-to-tail connections with some head-to-head type connections in the structure. These low branch ratio oligomers have high viscosity indices at least about 15 to 20 units and typically 30–40 units higher than equivalent viscosity prior art oligomers, which regularly have higher branch ratios and correspondingly lower viscosity indices. These low branch oligomers maintain better or comparable pour points.

The branch ratios defined as the ratios of $CH_3$ groups to $CH_2$ groups in the reaction products and by-products are calculated from the weight fractions of methyl groups obtained by infrared methods, published in *Analytical Chemistry,* Vol. 25, No. 10, p. 1466 (1953).

$$\text{Branch ratio} = \frac{\text{wt fraction of methyl group}}{1 - (\text{wt fraction of methyl group})}$$

The unique olefinic dimers used as alkylating agent in the present invention are produced as by-product of the HVI-PAO oligomerization reaction. Typically, in the production of HVI-PAO oligomer lubricant base stock, the oligomerization reaction mixture is separated from the catalyst and separated by vacuum distillation to remove unreacted alpha-olefin and lower boiling by-products of the oligomerization reaction, such as alpha-olefin dimer. This provides a lubricant basestock of suitably high volatility and viscosity. While other methods known to those skilled in the art, such as solvent extraction, may be used to separate the alpha-olefin dimer by-product, distillation is preferred.

The following examples are presented to illustrate the oligomerization reaction and lubricant grade oligomers produced therefrom. The reaction provides as a by-product the olefinic dimer used as alkylating agent or reactant in the present invention. The dimer is separated by distillation from the oligomerization reaction mixture.

EXAMPLE 1

Catalyst Preparation and Activation Procedure 1.9 grams of chromium (II) acetate ($Cr_2(OCOCH_3)_4 2H_2O$) (5.58 mole) (commercially obtained) is dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open-dish at room temperature. First, the dry solid (20 g) is purged with $N_2$ at 250° C. in a tube furnace. The furnace temperature is then raised to 400° C. for 2 hours. The temperature is then set at 600° C. with dry air purging for 16 hours. At this time the catalyst is cooled down under $N_2$ to a temperature of 300° C. Then a stream of pure CO (99.99% from Matheson) is introduced for one hour. Finally, the catalyst is cooled down to room temperature under $N_2$ and ready for use.

EXAMPLE 2

The catalyst prepared in Example 1 (3.2 g ) is packed in a ⅜" stainless steel tubular reactor inside an $N_2$ blanketed dry box. The reactor under $N_2$ atmosphere is then heated to 150° C. by a single-zone Lindberg furnace. Prepurified 1-hexene is pumped into the reactor at 140 psi and 20 cc/hr. The liquid effluent is collected and stripped of the unreacted starting material and the low boiling material at 0.05 mm Hg. The residual clear, colorless liquid has viscosities and VI's suitable as a lubricant base stock.

| | Sample | | | |
|---|---|---|---|---|
| | Prerun | 1 | 2 | 3 |
| T.O.S., hr. | 2 | 3.5 | 5.5 | 21.5 |
| Lube Yield, wt % | 10 | 41 | 74 | 31 |
| Viscosity, cS, at | | | | |
| 40° C. | 208.5 | 123.3 | 104.4 | 166.2 |
| 100° C. | 26.1 | 17.1 | 14.5 | 20.4 |
| VI | 159 | 151 | 142 | 143 |

EXAMPLE 4

A commercial chrome/silica catalyst which contains 1% Cr on a large-pore volume synthetic silica gel is used. The catalyst is first calcined with air at 800° C. for 16 hours and reduced with CO at 300° C. for 1.5 hours. Then 3.5 g of the catalyst is packed into a tubular reactor and heated to 100° C. under the $N_2$ atmosphere. 1-Hexene is pumped through at 28 cc per hour at 1 atmosphere. The products are collected and analyzed as follows:

| | Sample | | | |
|---|---|---|---|---|
| | C | D | E | F |
| T.O.S., hrs. | 3.5 | 4.5 | 6.5 | 22.5 |
| Lube Yield, % | 73 | 64 | 59 | 21 |
| Viscosity, cS, at | | | | |
| 40° C. | 2548 | 2429 | 3315 | 9031 |
| 100° C. | 102 | 151 | 197 | 437 |
| VI | 108 | 164 | 174 | 199 |

Since the lubricants prepared by the methods described above contain olefinic unsaturation they are typically hydrogenated to stabilize them for lubricant use. However, very high molecular weight oligomers may not need to be hydrogenated since the number of olefin bonds in such oligomers is comparatively small. Lower molecular weight oligomers of particular interest in the present invention to provide low viscosity lubricants are hydrogenated by means well known to those skilled in the lubricant arts.

In the present invention, the thermal stability of the hydrogenated lubricant range oligomers is improved by reaction with an olefin, preferably the non-lube range olefins produced as a by-product in the oligomerization reaction. Without wishing to be held by theoretical consideration, the reaction employed herein to modify HVI-PAO oligomer is described as an alkylation reaction and the reactant alkene as an alkylating agent. Although alkylation is a significant reaction occurring in the instant invention carried out under alkylation conditions, other reactions are occurring as well, e.g., cracking, isomerization and polymerization. Accordingly, the term alkylation as used herein includes all those reactions occurring that result in the beneficial modification of HVI-PAO oligomers as herein described.

The catalyst used in the alkylation reaction of the present invention is preferably a porous, solid acidic catalyst containing large pore openings. A preferred catalyst is a fluorided alumina, prepared as described hereinafter. Other useful solid catalysts include acidic zeolites. Zeolites useful as catalysts in the present invention include all natural or synthetic acidic large pore size zeolites, typically with a pore size of about 6.4 to 7.5 Angstroms. In addition to fluorided alumina, particularly useful catalysts include the acidic form of ZSM-4, ZSM-12, ZSM-20, Faujasite X & Y with pore size of 7.4 Angstroms, Cancrinite, Gmelinite, Mazzite, Mordenite and Offretite. Other alkylation catalysts which are also useful in the process of the present invention include conventional alkylation catalysts known to those skilled in the art including HF, $AlCl_3$, $BF_3$ and $BF_3$ complexes, $SbCl_5$, $SnCl_4$, $TiCl_4$, $P_2O_5$, $H_2SO_4$, $ZnCl_2$ and acidic clays.

The alkylation reaction of the present invention produces alkylated synthetic lube containing large alkyl branches. The alkyl branches preferably contain between 12 and 40 carbon atoms, or mixtures thereof, depending on the olefin used in the alkylation reaction, e.g. the dimer of the $C_6$–$C_{20}$ alpha-olefin. Branches containing between 2 and 40 carbon atoms can be produced when monomeric olefins, e.g. ethylene, propylene, 1-decene, are used as alkylating agent. The degree of large branching, i.e. branching introduced by the olefin, can be controlled by the mole ratio of alkene such as dimer olefin to synthetic lube in the alkylation reaction. In general, the molar ratio of olefin to the lube range material will be between about 40 to 1 and 1 to 1, preferably between about 5 to 1 and 1 to 1 molar ratio. As a result the product characteristics can range from synthetic lube containing at least one large alkyl group per mole to a reaction product containing a mixture of alkylated synthetic lube and synthetic lube. Surprisingly, it has been found that when the synthetic lube is HVI-PAO oligomer, alkylation with alkene dimer according to the present invention produces an alkylated product that maintains the high VI and low pour point of the unalkylated HVI-PAO oligomer and shows an increase in thermal stability.

The following Examples illustrate the preparation of a preferred alkylation catalyst of the present invention and further illustrate the novel alkylation reaction.

EXAMPLE 5

Alkylation Catalyst Preparation 25 grams of alumina (Harshaw Catapal-S, 1/32 inch extrudate) is contacted with 15.8 grams of aluminum nitrate nona hydrate in 30cc water for 1 hour. After the contact, excess water is removed under reduced pressure at 80° C. The aluminum nitrate impregnated alumina is then contacted with 8.17 grams ammonium fluoride in 50cc water to form aluminum fluoride in the alumina. The aluminum fluoride/alumina catalyst is dried under vacuum at 115° C. for 18 hours and then calcined at 538° C. for 12 hours.

EXAMPLE 6

Synthetic Lube/Dimer Preparation

Synthetic lube is prepared according to the process for HVI-PAO reacting 1-decene over chromium supported silica as previously described herein. The unsaturated decene dimer is separated by distillation as a by-product to remove unreacted decene and lubricant product hydrogenated. The lube product viscosity was 9.2 cS, measured at 100° C.

EXAMPLE 7

Alkylation of HVI-PAO Lube

Alkylation reactions are performed in a fixed-bed reactor. The unit is maintained at 400 psig and the liquid hourly space velocity (LHSV) is 0.5. The feed is a mixture of 315 grams of 1-decene HVI-PAO lube and 140 grams of 1-decene dimer representing 30.8 weight percent. Alkylation reactions are carried out at reaction temperatures of 167°, 204° and 250° C., Examples 7-1, 7-2 & 7-3. The results of these alkylation reactions are presented in Table 1

TABLE 1

| | Example | | | |
|---|---|---|---|---|
| | Feed | 7-1 | 7-2 | 7-3 |
| Reaction Temp. °C. | — | 167 | 204 | 250 |
| LHSV | — | 0.5 | 0.5 | 0.5 |
| Pressure, PSIG | — | 400 | 400 | 400 |
| HVI-PAO Charged, gms | — | 40.3 | 50.3 | 46.2 |
| HVI-PAO recovered, gms | — | 46.7 | 57.3 | 50.1 |
| % weight increase | — | 15.9 | 13.9 | 8.4 |
| KV, 40° C. | 50.0 | 74.0 | 79.5 | 70.5 |
| KV, 100° C. | 9.2 | 11.7 | 12.1 | 11.3 |
| Viscosity Index (VI) | 167 | 153 | 148 | 154 |
| Molecular Weight | 710 | 786 | 795 | 825 |

Based upon the initial percent of HVI-PAO present in the feed, the amount of HVI-PAO fed can be calculated and is found in Table 1 for each example. After alkylation, a weight increase is expected and is noted in the table. Weight increases vary between 8.4 and 15.9 percent and appear to be a function of reaction temperature.

With this method the overall yield of final product is increased by the addition by alkylation of dimer by-product to the synthetic HVI-PAO lubricant. The alkylated product has an increased viscosity compared to the starting HVI-PAO lubricant and maintains the high VI characteristic of these oligomers.

The following examples further illustrate the process of the present invention. Surprisingly, as illustrated hereinafter, it has been discovered that the process of alkylation imparts a substantial increase in the thermal stability of the resulting lubricants. Unalkylated HVI-PAO losses 35% of its viscosity, measured at 100° C., when subjected to a temperature of 300° C. for 24 hours in an inert environment. When the same HVI-PAO is alkylated with byproduct dimer, to the extent of 30% alkylation, the viscosity loss is reduced to 10%.

EXAMPLE 8

Catalyst Preparation 25 grams of alumina is contacted with a solution comprised of 5.3 grams of alumina nitrate (nonahydrate) in 30ml of water for one hour. Excess water is removed by vacuum. The dried alumina nitrate impregnated alumina is then contacted with another solution containing 2.7 grams of ammonium fluoride in 50ml of water. After about five minutes the excess water is decanted and the resulting fluorided alumina is dried in vacuum at 95° C. for three days. This catalyst contains about 5% aluminum fluoride.

EXAMPLE 9

Alkylation Reaction 7.0 grams of the above fluorided alumina catalyst is placed into a fixed-bed reactor and calcined at 538° C. for 18 hours. A feed comprised of 300grams (61.2% by weight) of a 18.9 cS (@100° C.) HVI-PAO and 190 grams (38.8% by weight) of by-product decene dimers is passed over the fluorided alumina catalyst under condition found in Table 2 for Examples 9-1, 9-2 and 9-3. The degree of alkylation is measured by the percent weight increase of the examples. The degree of alkylation varies from 7.5 to 30.6%.

In Table 3 the results of the thermal stability studies on the above alkylation products is presented. The unalkylated HVI-PAO, when subjected to a temperature of 300° C. for 24 hours in an inert atmosphere losses 35.4% of its viscosity, measure at 100° C. As the degree of alkylation is increased the stability of the alkylated HVI-PAO increases. At 30.6% alkylation the viscosity loss is reduced to 10.1% ( @ 100° C.).

In the figure the relationship between degree of alkylation and viscosity loss is presented. This demonstrates the increased thermal stability of alkylated HVI-PAO, according to the present invention.

TABLE 2

| | Example | | | |
|---|---|---|---|---|
| | Feed | 9-1 | 9-2 | 9-3 |
| Reaction Temp. °C. | — | 138 | 139 | 139 |
| LHSV | — | 0.5 | 0.5 | 0.5 |
| Pressure, PSIG | — | 400 | 350 | 350 |
| HVI-PAO Charged, gms | — | 22.2 | 23.8 | 53.0 |
| HVI-PAO recovered, gms | — | 29.0 | 26.7 | 57.0 |
| % weight increase | — | 30.6 | 12.2 | 7.5 |
| KV, 40° C. | 18.9 | 15.4 | 17.0 | 16.5 |
| KV, 100° C. | 130.9 | 103.6 | 115.2 | 108.5 |
| Viscosity Index (VI) | 164.1 | 157.5 | 161.3 | 165.3 |
| Molecular Weight | 1054 | 871 | 997 | 978 |

TABLE 3

| | Thermal Stability (300° C. for 24 hours) | | | | | | |
|---|---|---|---|---|---|---|---|
| | Before thermal treatment | | | After thermal treatment | | | |
| Example | KV, 40° C. | KV, 100° C. | VI | KV, 40° C. | KV, 100° C. | VI | % loss |
| HVI-PAO | 130.9 | 18.9 | 164 | 75.9 | 12.3 | 159 | 35.4* |
| 9-1 | 103.6 | 15.4 | 158 | 91.3 | 13.9 | 155 | 10.1* |
| 9-2 | 115.2 | 17.0 | 161 | 84.7 | 13.5 | 163 | 20.4* |
| 9-3 | 108.5 | 16.5 | 165 | 74.8 | 12.3 | 163 | 25.7* |

*based on 100° C. viscosity loss

In the following Example, HVI-PAO is alkylated as described above using the same fluorided alumina catalyst, except 1-decene alone was mixed with the HVI-PAO for reaction instead of HVI-PAO dimer.

EXAMPLE 10

18.9cS HVI-PAO Oligomer alkylated with 1-decene

Conditions:

| | |
|---|---|
| Reaction temp, °C. | 169 |
| Pressure, psig | 400 |
| LHSV | 0.4 |
| HVI-PAO charged, gms | 30.7 |

Results:

| | |
|---|---|
| HVI-PAO recovered, gms | 36.6 |
| % weight increase | 19.2 |
| KV, 40° C. | 13.1 |
| KV, 100° C. | 84.7 |
| VI | 155.6 |

Table 4 presents the thermal stability test results on the product of Example 10.

TABLE 4

| | KV, 40° C. | KV, 100° C. | VI | % Loss |
|---|---|---|---|---|
| Before Thermal Treatment | 84.7 | 13.1 | 156 | — |
| After Thermal Treatment | 75.7 | 12.0 | 154 | 8.4 |

Figure 2:
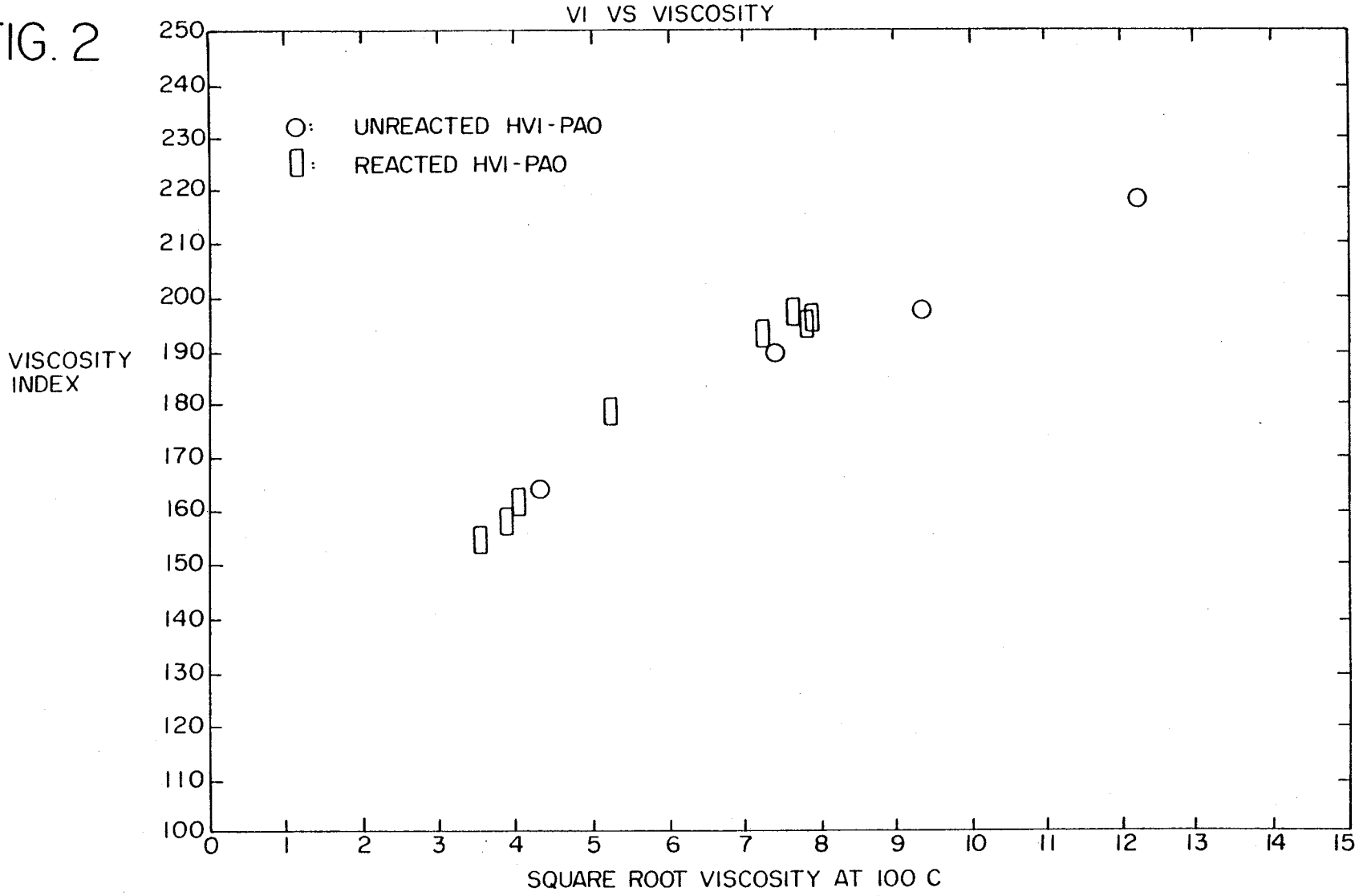
FIG. 2 shows the relationship between viscosity and viscosity index for HVI-PAO oligomer and modified HVI-PAO oligomer.

FIG. 2 shows a comparison of viscosity and VI for unreacted vs reacted HVI-PAO illustrating that VI remains unchanged for the reacted product of the invention.

While the invention has been described with preferred embodiments, the inventive concept is not limited except as set forth in the following claims.

What is claimed is:

1. A process for the conversion of alpha-olefins to high viscosity index lubricant range hydrocarbons in increased yield, comprising:

i. contacting $C_6$ to $C_{20}$ alpha-olefin feedstock, or mixtures, thereof, under oligomerization conditions with a reduced valence state Group VIB metal catalyst on porous support whereby an oligomerization product mixture is produced containing oligomers comprising olefinic lubricant range hydrocarbons and olefinic non-lubricant range hydrocarbon by-product;

ii. separating said lubricant and non-lubricant hydrocarbons and hydrogenating said lubricant range hydrocarbons;

iii. contacting said hydrogenated hydrocarbons and alkylating agent comprising said olefinic by-product in an alkylation zone under alkylating conditions with solid acidic catalyst whereby alkylated lubricant range hydrocarbons are produced.

2. The process of claim 1 wherein said alkylating agent comprises the olefinic $C_{12}$–$C_{40}$ dimer fraction of said oligomerization product.

3. The process of claim 1 wherein said solid acidic catalyst is taken from the group comprising large pore size zeolite and fluoridized alumina.

4. The process of claim 1 wherein said alkylated lubricant range hydrocarbons have viscosity index greater than 130, pour point below −15° C. and viscosity between 3cS and 750cS.

5. The process of claim 1 wherein said metal catalyst comprises chromium oxide on silica reduced with carbon monoxide.

* * * * *